US005372741A

United States Patent [19]

Tomaszewski

[11] Patent Number: 5,372,741

[45] **Date of Patent: * Dec. 13, 1994**

[54] AQUEOUS DEGREASING COMPOSITION AND PROCESS

[75] Inventor: Lillie C. Tomaszewski, Dearborn, Mich.

[73] Assignee: Ethone-OMI, Inc., Warren, Mich.

[ * ] Notice: The portion of the term of this patent subsequent to Mar. 9, 2010 has been disclaimed.

[21] Appl. No.: 799,565

[22] Filed: Nov. 27, 1991

[51] Int. Cl.[5] ..... C11D 1/10; C11D 1/12; C11D 7/36; C23G 5/00

[52] U.S. Cl. ..... 252/156; 134/40; 252/158; 252/545; 252/546; 252/558; 252/559; 252/174.14; 252/174.16

[58] Field of Search ..... 252/156, 174.14, 174.16, 252/558, 559, 545, 546, 156, 158; 134/40

[56] References Cited

U.S. PATENT DOCUMENTS

| | | | |
|---|---|---|---|
| 3,010,907 | 11/1961 | Carroll | 252/135 |
| 3,031,408 | 4/1962 | Perlman | 252/159 |
| 3,738,943 | 6/1973 | Kaneko | 252/540 |
| 3,741,913 | 6/1973 | Waag | 252/544 |
| 4,048,121 | 9/1977 | Chang | 252/527 |
| 4,137,190 | 1/1979 | Chakrabarti et al. | 252/135 |
| 4,140,647 | 2/1979 | Mizutani et al. | 252/156 |
| 4,214,915 | 7/1980 | Dillarstone et al. | 252/156 |
| 4,242,217 | 12/1980 | Westermann et al. | 252/135 |
| 4,349,448 | 9/1982 | Steele | 252/135 |
| 4,382,825 | 5/1983 | McCready | 134/2 |
| 4,390,465 | 6/1983 | Spekman | 252/527 |
| 4,457,322 | 7/1984 | Rubin et al. | 134/2 |
| 4,521,332 | 6/1985 | Milora | 252/527 |
| 4,539,134 | 9/1985 | Martin et al. | 252/156 |
| 4,578,208 | 3/1986 | Geke et al. | 252/135 |
| 4,582,636 | 4/1986 | Crossin | 252/546 |
| 4,613,449 | 9/1986 | Dingess | 252/156 |
| 4,725,281 | 2/1988 | Stehlin et al. | 252/539 |
| 4,731,194 | 3/1988 | Rossmann et al. | 252/160 |
| 4,741,863 | 5/1988 | Yamamoto et al. | 252/156 |
| 4,746,453 | 5/1988 | Chen et al. | 252/135 |
| 4,762,638 | 8/1988 | Dollman et al. | 252/135 |
| 4,857,114 | 8/1989 | Brumbaugh et al. | 134/42 |
| 4,869,844 | 9/1989 | Johnson | 252/156 |
| 5,064,561 | 11/1991 | Rouillard | 252/156 |
| 5,108,660 | 4/1992 | Michael | 252/545 |
| 5,114,620 | 5/1992 | Garvey et al. | 252/558 |
| 5,192,461 | 3/1993 | Tomaszewski et al. | 258/156 |

OTHER PUBLICATIONS

McCutcheons 1982 Functional Materials p. 199.

Chemical Abstracts online database information for Registry No. 9084-06-4, 1992.

*Primary Examiner*—Linda Skaling

*Attorney, Agent, or Firm*—Harness, Dickey & Pierce

[57] ABSTRACT

An aqueous degreasing composition which is free of silicates, chelates and inorganic phosphates and a method for degreasing metal substrates which are sensitive to these types of compositions. The composition of the present invention includes: an alkali builder constituent which contains no phosphates, silicates or chelates; and a nonionic surfactant effective amounts for removing oils from a substrate, a hydrotrope constituent in effective amounts for solubilizing the soils removed and for solubilizing the nonionic surfactant and an amphoteric surfactant in effective amounts for removing long chain soils from substrates and a salt of polymerized alkyl naphthalene sulfonic acid as a dispersant with the remainder being water. In the method of the present invention, the above composition is diluted from about 1% to about 100% by volume with water to provide a desoiling solution. The solution is then heated to a temperature from about 100° F. to about 200° F. A part requiring removal of soils is immersed into the solution and thereafter some type of agitation is used with the part and solution for an effective amount of time to remove soils from the part.

30 Claims, No Drawings

AQUEOUS DEGREASING COMPOSITION AND PROCESS

BACKGROUND OF THE INVENTION

The present invention relates to an aqueous desoiling or degreasing composition which in particular is free of silicates, chelates and inorganic phosphates. More particularly, the present invention relates to a composition and method of desoiling or degreasing metal substrates which are sensitive to silicates, chelates and inorganic phosphates.

Detergents and degreasing compositions have long relied on inorganic phosphates and silicates in their formulas for providing advantageous emulsification of oils and greases and the like. While such compositions are clearly effective in degreasers or other types of detergents these compositions are environmentally undesirable and also are undesirable from the standpoint of certain metals which may be detrimentally affected by the presence of these substances. For instance, brass, zinc, white metals, and aluminum base metals are particularly susceptible to attack by phosphates and chelates. Additionally, some types of metals may also be detrimentally affected by the presence of silicates. Similarly, chelating agents are also undesirable both from an environmental standpoint and from an incompatibility to certain substrates standpoint. Thus. U.S. Pat. Nos. 3,010,907; 3,031,408; 3,738,943; 3,741,913; 4,137,190; 4,214,915; 4,521,332; 4,539,134; and 4,857,114 all disclose various cleaning compositions which include silicates, inorganic phosphates and/or chelates in their compositions, which are undesirable as set forth above. In addition, these patents do not recite a salt of a polymerized naphthalene sulfonic acid dispersing agent which is critical in the building of silicate chelate and phosphate free de-greasing compositions of the present invention.

Thus, it is a goal in the present invention to provide a silicate, chelate and inorganic phosphate-free degreasing composition which will be effective in dilute quantities to decrease heavy soils from machine parts.

In the remainder of the specification all percentages are by weight unless otherwise recited.

SUMMARY OF THE INVENTION

In accordance with the present invention there is provided an aqueous degreasing composition which is free of silicates, chelates and inorganic phosphates and a method for degreasing metal substrates which are sensitive to these types of compositions. The composition of the present invention includes: an alkali builder constituent which contains no phosphates, silicates or chelates; a nonionic surfactant in effective amounts for removing oils from a substrate; a hydrotrope constituent in effective amounts for solubilizing the soils removed and for solubilizing the nonionic surfactant; and, an amphoteric surfactant in effective amounts for removing long chain soils from substrates and a salt of polymerized alkyl naphthalene sulfonic acid as a dispersant.

In accordance with the method of the present invention, the above composition is diluted from about 1% to about 99% by volume with water to provide a desoiling solution. The solution is then heated to a temperature of from about 100° F. to about 200° F. A part requiring removal of soils is immersed into the solution and thereafter some type of agitation is used for an effective amount of time to remove soils from the part.

Further understanding of the present invention will be realized, including further benefits and advantages thereof, upon review of the description of the preferred embodiments, the examples herein and the appended claims.

DESCRIPTION OF THE PREFERRED EMBODIMENTS

According to the present invention there is provided an aqueous degreasing composition free of silicates, chelates and inorganic phosphates for desoiling of metal substrates. In its broadest aspects, compositions of the present invention include: an alkali builder constituent which contains no phosphates, silicates or chelates; a nonionic surfactant in effective amounts for removing oils from a substrate; a hydrotrope constituent in effective amounts for solubilizing the soils removed and for solubilizing the nonionic surfactant; an amphoteric surfactant in effective amounts for removing long chain soils from substrates; and a salt of polymerized alkyl naphthalene sulfonic acid as a dispersant. Critical in the present invention is the combination of the silicate, chelate and inorganic phosphate-free alkali builders with the salt of a polymerized alkyl naphthalene sulfonic acid and the amphoteric surfactant.

Compositions of the present invention include from about 17% to about 55% of an alkali builder constituent free of silicates, chelates and inorganic phosphates. The alkali builder constituent more preferably includes from about 7% to about 25% of an alkali carbonate or bicarbonate builder; and from about 10% to about 30% of an alkali hydroxide builder. Preferred compositions of the present invention also include: from about 2% to about 8% of the dispersant which is more preferably a salt of a polymerized alkyl naphthalene sulfonic acid; from about 15% to about 25% of a hydrotrope which is more preferably a phosphate ester; from about 2% to about 6% of the nonionic surfactant which is more preferably an ethoxylated fatty alcohol; and from about 2% of about 6% of the amphoteric surfactant which more preferably is an alkyl imidazolinium carboxylated or sulfonated alkali salt with the remainder being water.

In accordance with the methods of the present invention, the above composition is diluted from about 1% to about 99% by volume and more preferably from about 1% to about 20% with water to provide a degreasing solution. The solution is then heated to a temperature of from about 100° F. to about 200° F. A part requiring degreasing or desoiling is immersed into the solution and thereafter some type of agitation is used with the part and solution to form an effective amount of time to remove the soil from the part.

In the present invention many types of alkali builders can be utilized provided they contain no silicates, phosphates or chelates. Thus, alkali builders suitable in the present invention are selected from such builders as alkali carbonates, alkali sesquicarbonates, alkali bicarbonates, and alkali hydroxides. A mixture of alkali carbonates and alkali hydroxides is preferred. A particularly preferred alkali builder mixture includes the combination of potassium carbonate, sodium bicarbonate and potassium hydroxide as set forth above.

In a preferred embodiment the alkali carbonate type builder is a mixture of an alkali carbonate with an alkali bicarbonate. Typically, from about 5% to about 15% potassium carbonate is utilized with about 2% to about 10% of sodium bicarbonate. Preferably, from about 5% to about 7% sodium bicarbonate is used with about 9% to about 11% potassium carbonate.

As stated above, the alkali hydroxide constituent of the present invention is preferably potassium hydroxide which may be utilized in a 45% solution and in a preferred embodiment such solution is utilized in quantities of from about 10% to about 15%.

The salt of a polymerized alkyl naphthalene sulfonic acid is a dispersant in the present invention and is most preferably a sodium salt of an alkyl naphthalene sulfonic acid utilized in quantities of from about 5% to about 6%. A particularly suitable dispersant of this type is a salt of the following alkyl naphthalene sulfonic acid:

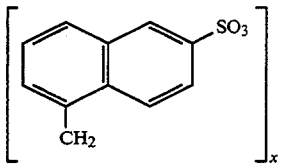

wherein x is selected such that the resulting polymer is a low molecular weight naphthalene sulfonate formaldehyde condensate, and is commercially obtainable as a Daxad 11 from W. R. Grace and Company. Other suitable dispersants include sodium or potassium salts of polymerized alkyl naphthalene sulfonic acids such as: Daxad 11G and KLS obtained from W. R. Grace and Co.; Blancol N obtained from Rhone Poulene Surfactants; Harol KG obtained from Graden Chemical Co., Inc.; Lomar LS obtained from Henkel Corp.; Petro Dispersant 425 obtained from Witco Corp.; and Tamal obtained from Rohm & Haas Co. This constituent is critical in the present invention to provide proper desoiling and degreasing in the aqueous compositions of the present invention in that it is effective in preventing re-deposition of soils onto substrates. This is particularly critical because the present invention is utilized for cleaning of heavy soils previously cleaned by solvents making re-deposition of soils a particular problem in aqueous solutions which is overcome in the present invention. The polymerized salt of alkyl naphthalene sulfonic acid provides improved dispersion of heavy oils and waxes in the solution thereby preventing them from redepositing onto the substrate surface.

The phosphate ester utilized in the present invention can be a phosphate ester acid or a phosphate ester of an alkali salt. In a preferred embodiment, the phosphate ester of potassium salt is utilized in quantities of from about 17% to about 20%. This constituent acts as a hydrotrope in the present invention and is preferably a potassium salt. The hydrotrope advantageously acts to solubilize most oils and also has the benefit of solubilizing the nonionic surfactant constituents utilized in the present invention. This material is preferably a Triton H-55 composition obtained from Rohm & Haas. Other suitable phosphate esters include those sold under the tradename Triton H-66. For instance, other suitable hydrotropes include: Alkaphos BG-56A, L-3-15A, L4-27A, R5-09A and R5-095 obtained from Rhone Poulene Surfactants: Chemfac PD 600, PA-PB's, PC-PO's, PN-32 obtained from Chemax, Inc.; Gafac BG510 obtained from Rhone Poulene Surfactants; Klearfac AA270 obtained from BASF Wyandotte; Maphos 79, 91,236 obtained from Mazur Chemicals; and Triton H-55, H-66 obtained from Union Carbide and Chemicals.

As stated above, in a particularly preferred embodiment, the nonionic surfactant constitutent is an ethoxylated fatty alcohol and in a most preferred embodiment has the formula $(C_2H_4O)_nC_{18}H_{30}O$ wherein n=10). The nonionic surfactant constituent of the present invention advantageously acts to remove oils and other soils from the substrates which are thereafter solubilized by the hydrotrope constituent. In a most preferred embodiment, this constituent is utilized in quantities of from about 3% to about 5%. For instance, a composition such as IGEPAL RC620 obtained from GAF may be utilized for this constituent in the present invention.

As stated above, the amphoteric surfactant is a critical element in the present application. In a particularly preferred embodiment, from about 3% to about 5% of an alkyl imidazolinium carboxylated or sulfonated alkali salt is utilized. Most preferred is an alkyl imidazolinium dicarboxylated sodium salt which may be provided in the compositin in the form of a Miranol C-2 M-SF composition obtained from Miranol Chemical Company.

In accordance with the process of the present invention, degreasing solutions utilizing the concentrate set forth above may be utilized in solutions containing from about 1% to 99% and more preferably from about 1% to about 20% by volume of the concentrate as set forth above mixed with water. Of course, for extremely harsh soils the concentration of the concentrate will be higher than in relatively mild applications. Similarly, if lower concentrations of the concentrate are utilized, higher temperatures and greater physical agitation with greater time periods may be utilized to compensate for lower concentrations. Thus, the temperature of treatment of the soiled part which is preferably from about 100° F. to about 200° F. may be adjusted depending on the types of soils to be removed or the concentration of the composition in the solution.

Parts to be degreased may be placed in a cleaning bath after raising the temperature to from about 100° F. to about 200° F. The method of the present invention is effective when soak cleaning soiled parts, however, physical agitation is a preferred method for desoiling and degreasing parts. A barrel type washer or ultrasonics could be used for physical agitation of the solution.

The time of degreasing is typically from about 5 minutes to about 30 minutes but may be adjusted for longer or shorter periods of time as may be required in particular applications. Degreasing in accordance with the methods of the present invention provides finished surfaces free of water breaks.

Compositions and processes of the present invention are suitable for removing soils formerly left to solvent type systems. Such soils include as examples dry film lubricants, marking inks, drawing compounds, paraffin wax residues, maskants, buffing compounds, tape residues, fluorescent penetrant inspection residue, and contaminated water soluble machining coolants.

Solutions of the present invention are effective on such substrates as ferrous metals, steel alloys, titanium, titanium alloys, copper, copper alloys, stainless steels, cobalt base alloys, nickel alloys, magnesium alloys and. aluminum.

Further understanding of the present invention will be acquired from review of the following examples which are provided for purposes of illustration but not limitation.

EXAMPLE I

A degreasing concentrate is prepared in a two step process in the quantities set forth in the Table I below.

TABLE I

| Constituent | Quantity |
|---|---|
| $K_2CO_3$ | 100 g/l |
| $NaHCO_3$ | 60 g/l |
| KOH (45%) | 120 g/l |
| 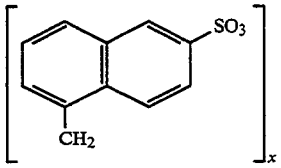 | 53.9 g/l |
| Phosphate ester sodium salt (Triton H-55) | 180 g/l |
| $(C_2H_4O)_nC_{18}H_{30}O$ n = 10 (Igepal RC620) | 56 g/l |
| alkyl imidazolinium dicarboxylated sodium salt (Miranol C2 MSF) | 40 g/l |
| $H_2O$ | 600 g/l |

The alkali salts $K_2CO_3$,$NaHCO_3$ and KOH are mixed with 400 g/l $H_2O$ separately from the remainder of the constituents. Thereafter, the two mixtures are combined to form the concentrate.

The degreasing concentrate contained no silicates, chelating agents or inorganic phosphates and is suitable for degreasing substrates in dilutions of 0.5% to 100%. The above solution is diluted to 2½% in the first case and was raised to a temperature of from about 140° F. to about 180° F. An aluminum part with cutting oil is thereafter immersed in the solution for 5 minutes. The part is found to have no water breaking. The solution is found to have substantially no detrimental effect on the aluminum. The solution is used to de-soil brass zinc, white metals, stainless steels and is found to have no detrimental effect on these substrates.

EXAMPLE II

Utilizing the concentrate prepared in Example I, a 10% volume to volume solution was prepared. The solution is raised in temperature to 190° F. The solution is placed in an ultrasonic agitation machine. An aluminum part having buffing compounds thereon is immersed in the solution and agitated using ultrasonic agitation. The substrate which had buffing compounds thereon is found to be completely degreased after a period of 2 minutes with no water breaking. The solution is found to have no detrimental effect on the aluminum substrate. The solution is used to de-soil brass zinc, white metals, stainless steels and is found to have no detrimental effect on these substrates.

EXAMPLE III

A 15% volume to volume dilution is made of the concentrate prepared in Example I. The solution is raised to a temperature of from about 190° F. to 200° F. A barrel washer is used to degrease an aluminum part having cutting oils thereon. The part is degreased in a 10 minute time period. There was no water breaking on the part. The solution is found to have no detrimental effect on the aluminum substrate. The solution is used to de-soil brass zinc, white metals. stainless steels and is found to have no detrimental effect on these substrates.

EXAMPLE IV

A cleaning concentrate solution is made in accordance with the Table II below.

TABLE II

| Constituent | Quantity |
|---|---|
| $K_2CO_3$ | 5% |
| $NaHCO_3$ | 2% |
| KOH | 10% |
| 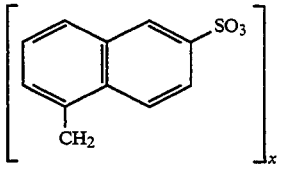 | 2% |
| Phosphate ester sodium salt (Triton H-55) | 15% |
| $(C_2H_4O)_nC_{18}H_{30}O$ n = 10 (Igepal RC620) | 2% |
| alkyl imidazolinium dicarboxylated sodium salt (Miranol C2 MSF) | 2% |
| $H_2O$ | remainder |

The above solution is diluted to concentrations of 1% to 20% and is raised to a temperature of from about 100° F. to about 200° F. A variety of substrates sensitive to silicates, chelates and inorganic phosphates with various heavy soils are thereafter immersed in these various concentrations of solutions and some were agitated for 1-30 minutes and some were soak cleaned. The parts are found to be sufficiently degreased with no damage to the substrates.

A more preferred composition is prepared utilizing 9% $K_2CO_3$, 5% $NaHCO_3$ and 10% KOH, 5% salt of polymerized alkyl naphthalene sulfonic acid (Daxad 11), 17% phosphate ester of sodium salt, 3% ethoxy fatty alcohol (Igepal RC620), 3% alkyl imidazolinium dicarboxylated sodium salt (Miranol C2 MSF) with the remainder water. This composition is diluted to 10% and is used for soak cleaning for about 10 minutes. This composition is then diluted to 5% to be used for barrel cleaning for about 5 minutes. The composition is also diluted to form a 3% solution for ultrasonic cleaning for about 3 minutes. Brass aluminum, copper, zinc, white metal and others are degreased with each of the solution. No water breaking is found and the substrates are not detrimentally affected.

EXAMPLE V

A concentrate cleaning solution is made in accordance with the Table III below.

TABLE III

| Constituent | Quantity |
|---|---|
| $K_2CO_3$ | 10% |
| $NaHCO_3$ | 10% |
| KOH | 30% |
| 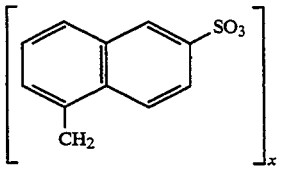 | 8% |
| Phosphate ester sodium salt (Triton H-55) | 25% |
| $(C_2H_4O)_nC_{18}H_{30}O$ n = 10 (Igepal RC620) | 6% |
| alkyl imidazolinium dicarboxylated sodium salt (Miranol C2 MSF) | 6% |

TABLE III-continued

| Constituent | Quantity |
|---|---|
| $H_2O$ | remainder |

The above solution is diluted to concentrations of 1% to 20% in the first case and is raised to a temperature of from about 100° F. to about 200° F. A variety of substrates sensitive to silicates, chelates and inorganic phosphates with various heavy soils are thereafter immersed in these various concentrations of solutions and agitated. The parts are found to be sufficiently degreased with no damage to the substrates.

A more preferred concentrate composition is prepared as follows: 7% $NaHCO_3$; 11% $K_2CO_3$; 15% KOH; 6% sodium salt of polymerized alkyl naphthalene sulfonic acid (Daxad 11); 20% phosphate ester (Triton H-55); 5% ethoxylated fatty alcohol (Igepal RC 620); 5% alkyl imidazolinium dicarboxylated sodium salt (Miranol C2 MSF); and the remainder being water. Dilutions of 10%, 5% and 3% are utilized for soak cleaning (5 minutes), barrel cleaning (3 minutes) and ultrasonic cleaning (1 minute) respectively. These solutions are found to clean substrates such as aluminum zinc, white metal, and brass. No water breaks are found after the cleanings. There are no detrimental effects to the substrates.

While the above description constitutes the preferred embodiments of the invention, it will be appreciated that the invention is susceptible to modification, variation, and change without departing from the proper scope or fair meaning of the accompanying claims.

What is claimed is:

1. An aqueous degreasing composition free of silicates, chelates and inorganic phosphates for de-soiling of metal substrates which are sensitive thereto comprising:

from about 17% to about 55% by weight of an alkali builder containing no phosphates, chelates or silicates;

from about 2% to about 8% by weight of salt of a polymerized alkyl naphthalene sulfonic acid;

from about 15% to about 25% by weight of a phosphate ester of an alkali salt;

from about 2% to about 6% by weight of an ethoxylated fatty alcohol;

from about 2% to about 6% by weight of an alkyl imidazolinium carboxylated or sulfonated alkali salt; and the remainder being water.

2. The aqueous degreasing composition of claim 1 further comprising 1% to 20% dilution of the composition in water.

3. The aqueous degreasing composition of claim 1 wherein said alkali builder constituent is selected from the group consisting of alkali carbonates, alkali bicarbonate, alkali sequicarbonates and alkali hydroxides.

4. The aqueous degreasing composition of claim 1 wherein the alkali builder constituent comprises by weight of the composition:

from about 5% to about 15% by weight of potassium carbonate;

from about 2% to about 10% by weight of sodium bicarbonate; and from about 10% to about 30% by weight of potassium hydroxide.

5. The aqueous degreasing composition of claim 1 wherein said phosphate ester is selected from the group consisting of phosphate ester acids and phosphate esters of an alkali salt.

6. The aqueous degreasing composition of claim 1 wherein the polymerized salt of an alkyl naphthalene sulfonic acid has the general polymer formula:

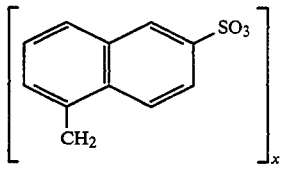

wherein x is selected such that the resulting polymer is a low molecular weight naphthalene sulfonate formaldehyde condensate.

7. An aqueous degreasing composition free of silicates, chelates, and inorganic phosphates for de-soiling of metal substrates which are sensitive to silicates. chelates and inorganic phosphates, said composition comprising:

from about 24% to about 33% by weight of an alkali builder containing no phosphates, chelates or silicates;

from about 5% to about 6% by weight of a polymerized sodium salt of an alkyl naphthalene sulfonic acid;

from about 17% to about 20% by weight of a phosphate ester;

from about 3% to about 5% by weight of an ethoxylated fatty alcohol;

from about 3% to about 5% by weight of an alkyl imidazolinium dicarboxylated sodium salt; and the remainder being water.

8. The aqueous degreasing composition of claim 7 further comprising a 1% to 20% dilution of the composition in water.

9. The aqueous degreasing composition of claim 7 wherein the alkali builder constituent is selected from the group consisting of potassium carbonate, sodium bicarbonate, potassium hydroxide and mixtures thereof.

10. The aqueous degreasing composition of claim 7 wherein said phosphate ester is selected from the group consisting of phosphate ester acids and phosphate esters of an alkali salt.

11. The aqueous degreasing composition of claim 7 wherein the polymerized salt of an alkyl naphthalene sulfonic acid has the general polymer formula:

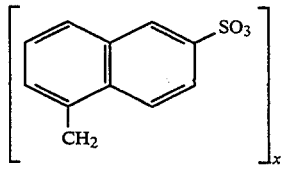

wherein x is selected such that the resulting polymer is a low molecular weight naphthalene sulfonate formaldehyde condensate.

12. A process of degreasing a metal substrate sensitive to silicates, chelates or inorganic phosphates comprising the steps of:

a) preparing an aqueous degreasing solution comprising an aqueous dilution of from about 1% to about 20% by volume of a concentrate in water comprising:

from about 17% to about 55% by weight of an alkali builder containing no phosphates, silicates or chelates;

from about 2% to about 8% by weight of polymerized salt of alkyl naphthalene sulfonic acid;

from about 15% to about 25% by weight of a phosphate ester of an alkali salt;

from about 2% to about 6% by weight of an ethoxylated fatty alcohol;

from about 2% to about 6% by weight of an alkyl imidazolinium carboxylated or sulfonated alkali salt; and the remainder being water;

b) heating the resultant solution to a temperature of from about 100° F. to about 200° F.; and c) immersing a part to be degreased into the solution.

13. The process of claim 12 wherein said alkali builder is selected from the group consisting of alkali carbonates, alkali bicarbonate, alkali sesquicarbonates, alkali hydroxides and mixtures thereof.

14. The process of claim 12 wherein said alkali builder constituent comprises by weight of the composition:

from about 5% to about 15% by weight potassium carbonate;

from about 2% to about 10% by weight sodium bicarbonate; and from about 10% to about 30% by weight potassium hydroxide.

15. The process of claim 12 wherein said phosphate ester is selected from the group consisting of phosphate ester acids and phosphate esters of an alkali salt.

16. The process of claim 12 wherein the polymerized salt of an alkyl naphthalene sulfonic acid has the general polymer formula:

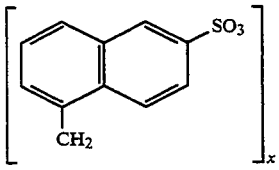

wherein x is selected such that the resulting polymer is a low molecular weight naphthalene sulfonate formaldehyde condensate.

17. The process of claim 12 wherein physical agitation of the solution is utilized during immersion of the part.

18. The process of claim 12 wherein ultrasonic agitation is utilized during immersion of the part.

19. The process of claim 17 wherein the proportion of the concentrate in water ranges from about 3% to about 7% by volume.

20. The process of claim 18 wherein the proportion of the concentrate in water ranges from about 1% to about 5% by volume.

21. The process of claim 16 wherein the proportion of the concentrate in water ranges from about 5% to about 15% by volume wherein the immersing step comprises soak cleaning.

22. A process of degreasing a metal substrate sensitive to silicates, chelates or inorganic phosphates comprising the steps of:

a) preparing an aqueous degreasing comprising an aqueous dilution of from about 1% to about 20% by volume of a concentrate comprising:

from about 24% to about 33% by weight of an alkali builder containing no phosphates, silicates or chelates; from about 5% to about 6% by weight of a polymerized sodium salt of an alkyl naphthalene sulfonic acid; from about 17% to about 20% by weight of a phosphate ester; from about 3% to about 5% by weight of an ethoxylated fatty alcohol; from about 3% to about 5% by weight of an alkyl imidazolinium dicarboxylated sodium salt and the remainder being water;

b) heating the resulting solution to a temperature of from about 100° F. to about 200° F.; and c) immersing a soiled part in the solution for an effective time for removal of soils from the part.

23. The process of claim 22 wherein the polymerized salt of an alkyl naphthalene sulfonic acid has the general polymer formula:

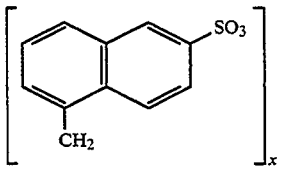

wherein x is selected such that the resulting polymer is a low molecular weight naphthalene sulfonate formaldehyde condensate.

24. The process of claim 22 wherein said alkali builder is selected from the group consisting of alkali carbonates, alkali bicarbonates, alkali sesquicarbonates, alkali hydroxides and mixtures thereof.

25. The process of claim 22 wherein said alkali builder constituent comprises by weight of the composition:

from about 5% to about 7% by weight of sodium bicarbonate;

from about 9% to about 11% by weight of potassium carbonate; and from about 10% to about 15% by weight of potassium hydroxide.

26. The process of claim 22 wherein physical agitation of the solution is utilized during immersion of the soiled part.

27. The process of claim 22 wherein ultrasonic agitation of the solution is utilized during immersion of the soiled part.

28. The process of claim 26 wherein the proportion of the concentrate in water ranges from 3% to 7% by volume.

29. The process of claim 27 wherein the proportion of the concentrate in water ranges from 1% to 5% by volume.

30. The process of claim 22 wherein the proportion of the concentrate in water ranges from 5% to 15% by volume wherein the immersing step comprises soak cleaning.

* * * * *

UNITED STATES PATENT AND TRADEMARK OFFICE

CERTIFICATE OF CORRECTION

PATENT NO. : 5,372,741

DATED : December 13, 1994

INVENTOR(S) : Lilie C. Tomaszewski

It is certified that error appears in the above-indentified patent and that said Letters Patent is hereby corrected as shown below:

Title page, item [56] line 4, 3,741,913, dated 03/13/92, "Waag" should be-- Stenungsund, dated 6/1973--.

Column 2, line 41, "of" should be --to--.

Column 4, line 63, "and." should be --and--.

Column 5, line 19, insert --wherein x is selected such that the resulting polymer is a low molecular weight naphthalene sulfonate formaldehyde condensate--.

Column 6, line 10, insert-- A salt of the following alkyl naphthalene sulfonic acid:--.

Column 6, line 17, insert--wherein x is selected such that the resulting polymer is a low molecular weight naphtalene sulfonate formaldehyde condnesate--.

column 6, line 66, before "Phosphate" insert --wherein x is selected such that the resulting polymer is a low molecular weight naphthalene sulfonate formaldehyde condensate--.

Column 5, line 12 and column 6, line 58, insert--a salt of the following alkyl naphthalene sulfonic acid:--

Signed and Sealed this

Second Day of January, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,372,741

DATED : December 13, 1994

INVENTOR(S) : Lillie C. Tomaszewski

It is certified that error appears in the above-indentified patent and that said Letters Patent is hereby corrected as shown below:

Title Page, item [73], line 1, "Ethone-OMI, Inc." should be --Enthone-OMI, Inc.--.

Signed and Sealed this

Third Day of September, 1996

*Attest:*

Bruce Lehman

BRUCE LEHMAN

*Attesting Officer*

*Commissioner of Patents and Trademarks*